US009035989B2

(12) United States Patent
Adachi et al.

(10) Patent No.: US 9,035,989 B2
(45) Date of Patent: May 19, 2015

(54) IMAGE FORMING APPARATUS WITH COUNT PORTION MEASURING ELECTRIC SIGNAL

(71) Applicant: CANON KABUSHIKI KAISHA, Tokyo (JP)

(72) Inventors: Motoki Adachi, Ashigarakami-gun (JP); Hideo Kihara, Yokohama (JP); Masanori Tanaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/098,779

(22) Filed: Dec. 6, 2013

(65) Prior Publication Data

US 2014/0168339 A1 Jun. 19, 2014

(30) Foreign Application Priority Data

Dec. 13, 2012 (JP) ..... 2012-272102

(51) Int. Cl.
*B41J 2/47* (2006.01)
*G03G 15/00* (2006.01)

(52) U.S. Cl.
CPC ..... *G03G 15/556* (2013.01)

(58) Field of Classification Search
CPC ..... G03G 13/045; G03G 15/043; G03G 15/5025; B41J 21/17
USPC ..... 347/118, 158, 240, 251, 254; 399/27, 399/29
See application file for complete search history.

(56) References Cited

U.S. PATENT DOCUMENTS

| | | | | |
|---|---|---|---|---|
| 5,740,502 | A | 4/1998 | Kobayashi et al. | |
| 7,770,987 | B2 | 8/2010 | Nakasendo | |
| 2012/0230705 | A1 * | 9/2012 | Shimura et al. | 399/26 |
| 2013/0004187 | A1 * | 1/2013 | Watanabe | 399/29 |

FOREIGN PATENT DOCUMENTS

| | | | |
|---|---|---|---|
| JP | 8-194355 | A | 7/1996 |
| JP | 2002-296853 | A | 10/2002 |
| JP | 2006-251420 | A | 9/2006 |
| JP | 2008-8991 | A | 1/2008 |
| JP | 4822578 | B2 | 11/2011 |

OTHER PUBLICATIONS

Office Action in Japanese Application No. 2012-272102, dated Aug. 5, 2014.

* cited by examiner

*Primary Examiner* — Hai C Pham
(74) *Attorney, Agent, or Firm* — Fitzpatrick, Cella, Harper & Scinto

(57) ABSTRACT

An image forming apparatus includes an image bearing member; a charging device; an exposure device configured to expose intermittently for each unit area of the image bearing member charged by the charging device to form a latent image; a developing device configured to develop the latent image with developer; a signal output portion configured to output a first electric signal when the exposure device exposes a print area of the image bearing member, and output a second electric signal, which instructs the exposure device to shorten an exposure time per unit area more than an exposure time of the first electric signal, when the exposure device exposes a non-print area of the image bearing member; and a count portion, to which the first and the second electric signals are input from the signal output portion, configured to measure only the first electric signal without measuring the second electric signal.

3 Claims, 8 Drawing Sheets

IMAGE FORMING APPARATUS WITH COUNT PORTION MEASURING ELECTRIC SIGNAL

BACKGROUND OF THE INVENTION

1. Field of the Invention

The present invention relates to an image forming apparatus utilizing an electrophotographic process. A copying machine, a printer, a facsimile machine, and a multifunction device having a combination of these functions are listed as examples of the image forming apparatus.

2. Description of the Related Art

Electrophotographic or electrostatic recording image forming apparatus use a DC contact charging method in which a DC voltage is applied as charging bias to a charging roller, which is a charging unit configured to charge a surface of a photosensitive member serving as an image bearing member, with the goal of being less damaging to the ozone layer, saving power, and being small in size.

Some further aim to reduce the size of a high-voltage unit by using a configuration which keeps the DC voltage applied to the charging roller at a given fixed value. In this case, a change brought to the surface electric potential of the photosensitive member after charging by a change in the film thickness of the photosensitive member or a change in the use environment of the photosensitive member is dealt with by a known method in which an exposure unit exposes other areas than a toner image forming area with light in an intensity weaker than the light intensity used to expose the toner image forming area (Japanese Patent Application Laid-Open No. 2002-296853). Exposing other areas to light in addition to the toner image forming area in this manner is hereinafter referred to as background area exposure.

Background area exposure has also been practiced for other purposes than keeping the voltage at a given fixed value, one of which is to reduce image density differences caused by a transfer memory (Japanese Patent Application Laid-Open No. 2008-8991).

Known methods of background area exposure include one in which the entire area is exposed with a weak light intensity, and one in which the other areas are exposed to light in the same intensity as in the toner image forming area for a shorter length of time than the exposure time of the toner image forming area (Japanese Patent Application Laid-Open No. H08-194355). The former method is hereinafter referred to as analog background area exposure. The latter method is hereinafter referred to as digital background area exposure. Digital background area exposure is effective in the case where exposure with a light intensity is not possible due to the characteristics of a laser element used as the exposure unit, or similar cases.

A known method of predicting the use amount of toner employs a count unit (counter unit: measurement unit) which counts electric signals (video signals) input to a laser driver configured to control a laser element which is provided in the exposure unit. The count unit samples a specific number of video signals in a pre-determined image area and counts a number of ON-state video signals. The coverage rate of a printed image is calculated from the ratio of the number of samples and the number of counts, and provides the basis for the prediction of the toner use amount.

The above method is hereinafter referred to as video count toner use amount predictive detection. Because signals which are actually input to the laser driver are measured directly, the toner use amount can be detected with precision (Japanese Patent No. 4822578).

However, performing the video count toner use amount predictive detection in an image forming apparatus which is equipped with the digital background area exposure function sometimes gives rise to the following problem.

The count unit measures any video signal input to the laser driver no matter what type the signal is. This means that a signal input to the laser driver to expose a non-print area where a toner image is not formed is measured as well. The exposure of the non-print area, however, does not consume toner. As a result of unnecessarily measuring the video signal of the non-print area in a toner use amount prediction through the video count toner use amount predictive detection, the detected toner use amount ends up being larger than the actual amount of toner used. A way to accurately detect video signals of a print area is being sought after for this reason.

SUMMARY OF THE INVENTION

An object of the invention of the patent application is therefore to detect electric signals for exposing a print area with light more accurately in an image forming apparatus which exposes a non-print area.

In order to achieve the above-mentioned object, an exemplary configuration of an image forming apparatus includes: an image bearing member; a charging device configured to charge a surface of the image bearing member; an exposure device configured to expose to light the image bearing member which has been charged by the charging device to form an electrostatic latent image, the exposure device intermittently irradiating the image bearing member with light for each unit area of the image bearing member; a developing device configured to develop the electrostatic latent image with developer; a signal output portion configured to output an electric signal which instructs the exposure device to perform exposure, the signal output portion outputting a first electric signal when the exposure device is to expose a print area of the image bearing member to light, and outputting a second electric signal, which instructs the exposure device to shorten an exposure time per unit area of the image bearing member more than an exposure time of the first electric signal, when the exposure device is to expose a non-print area of the image bearing member to light; and a count portion, to which the first electric signal and the second electric signal are input from the signal output portion, configured to measure only the first electric signal without measuring the second electric signal.

Further features of the present invention will become apparent from the following description of exemplary embodiments with reference to the attached drawings.

DESCRIPTION OF THE EMBODIMENTS

First Embodiment

An image forming apparatus according to the present invention will be described below in more detail with reference to the drawings. Embodiments described below are exemplifications of the present invention, and the dimensions, materials, shapes, relative arrangement, and the like of components in the following description are not to limit the scope of the present invention unless otherwise specifically noted.

<Overall Configuration of an Example of the Image Forming Apparatus>

Figure 1:
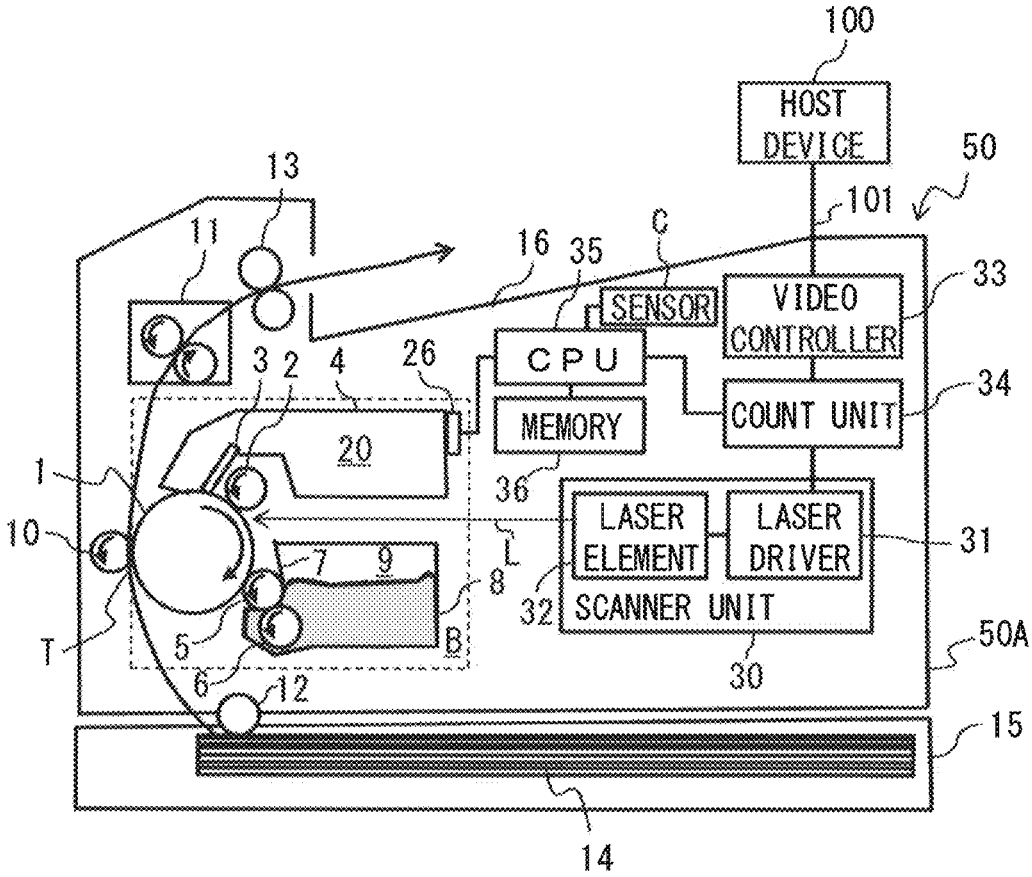
FIG. 1 is a schematic configuration diagram of an image forming apparatus according to a first embodiment.

FIG. 1 is a schematic configuration diagram of an image forming apparatus according to an embodiment of the present invention. The image forming apparatus 50 of the embodiment is a laser beam printer configured to form an image on a recording medium 14, for example, recording paper or an OHP sheet, according to image information by an electrophotographic printing method. A process cartridge B is detachably mountable to the image forming apparatus 50 of the embodiment, details of which will be described later.

The image forming apparatus 50 is connected to a host device 100 such as a personal computer (host PC) via an interface 101. A CPU 35 is a control unit (control portion) configured to control an image forming process (printing process) of the image forming apparatus 50. The CPU 35 handles processing of electrical information signals which are input from various process devices and sensors, processing of command signals which are commands to the various process devices, control of a given initial sequence, control of a given image creating sequence, and the like.

A video controller 33 processes a print request signal and image data which are sent from the host device 100, and inputs electric signals (video signals) representing the image data to a laser driver 31 disposed within a scanner unit 30, which is an exposure unit (exposure device). The laser driver 31 controls the light emission of a laser element 32 in time with the input of the video signals, thereby forming an electrostatic latent image on a photosensitive drum 1, which is an image bearing member. The scanner unit 30 is a digital exposure unit configured to intermittently expose the photosensitive drum 1 serving as an image bearing member with light for each unit area of the photosensitive drum 1. The video controller 33 is a signal output portion configured to output an electric signal which instructs the scanner unit 30 to perform exposure.

The image forming apparatus 50 is provided with the photosensitive drum 1, a charging roller 2, which is a charging unit (charging device/charging member) configured to charge the surface of the photosensitive drum 1 to a given polarity and electric potential, and a developing device (developing unit) 8, which develops a toner image by supplying toner to an electrostatic latent image formed on the photosensitive drum 1. The photosensitive drum 1 has a cylindrical shape with an external diameter of approximately 30 mm, and rotates at a speed of 100 mm/sec in the clockwise direction, which is indicated by an arrow in FIG. 1. The charging roller 2, serving as a contact charging member, is disposed so as to be in pressure contact with the photosensitive drum 1, and rotates in association with the rotation of the photosensitive drum 1.

The developing device 8 has a developing roller 5 which abuts against the photosensitive drum 1 to develop a latent image on the photosensitive drum 1 with toner. The developing device 8 also has a regulating blade 7, which is a regulating member configured to regulate the amount of toner on the developing roller 5, a toner supplying roller 6, which is a toner supplying member configured to supply toner to the developing roller 5, and a toner container 9, which contains toner. The average particle size of toner is approximately 6 μm. The developing roller 5 abuts against the photosensitive drum 1 in a development step, and a surface of the developing roller 5 which is in contact with the photosensitive drum 1 is driven to rotate in the same direction as the rotation direction of the photosensitive drum 1. In other steps than the development step, the rotation of the developing roller 5 is stopped and the developing roller 5 is kept apart from the photosensitive drum 1.

A transfer roller 10 by which a toner image formed on the photosensitive drum 1 is transferred onto the recording medium 14 abuts against the photosensitive drum 1. The abutment portion where the transfer roller 10 is in contact with the photosensitive drum 1 is a transfer nip portion T. The photosensitive drum 1 is provided with a cleaner unit 4 configured to remove untransferred toner which remains on the photosensitive drum 1 after a transfer step. The cleaner unit 4 has a cleaning blade 3, which is disposed in contact with the photosensitive drum 1 to remove toner, and an untransferred toner container 20, which contains the removed toner.

In the embodiment, the photosensitive drum 1, the developing device 8, the charging roller 2, and the cleaner unit 4 are integrated as the process cartridge B, which can be mounted to and detached from a given mounting portion inside an image forming apparatus main body 50A by a given procedure. A non-volatile memory 26 is mounted in the process cartridge B as a unit configured to store the history of use and cartridge information. The memory 26 exchanges information with the CPU 35 on the side of the image forming apparatus main body 50A.

The image forming apparatus 50 is provided with a recording medium containing portion 15 configured to contain sheets of paper or the like which is the recording medium 14, and a recording medium feeding unit 12 configured to pick up the recording medium 14 out of the recording medium containing portion 15 and convey the recording medium 14. A fixing unit 11 is provided as well so that a toner image transferred onto a recording medium is fixed to the recording medium by heat and pressure. Discharge rollers 13 are also disposed to send the recording medium 14 which has exited the fixing unit 11 and on which an image has been formed to a discharge portion 16.

The image forming apparatus 50 is also provided with an environment sensor C in order to detect the temperature and humidity of an environment in which the image forming apparatus is used. Detection information of the sensor C is input to the CPU 35.

<Image Forming Process>

The rotating photosensitive drum 1 is uniformly charged to a given polarity and electric potential by the charging roller 2 to which a given level of charging bias is applied from a power source unit (not shown). The uniformly charged photosensitive drum 1 is exposed (main-scan exposure) to laser light L, which is modulated according to image information and output from the scanner unit 30 serving as an exposure unit. An electrostatic latent image corresponding to the image information is formed as a result on the surface of the photosensitive drum 1. Thereafter, the developing roller 5 supplies developer to visualize the electrostatic latent image as a toner image. A given level of developing bias is applied to the developing roller 5 by the power source unit (not shown).

Meanwhile, one sheet is separated from the rest of the recording medium 14 and fed out of the recording medium containing portion 15 by the recording medium feeding unit 12. The sheet of the recording medium 14 is led to the transfer nip portion T at given control timing in synchronization with the timing of forming a toner image on the photosensitive drum 1, and passes through (conveyed while sandwiched between) the transfer nip portion T. A given level of transfer bias is applied to the transfer roller 10 from the power source unit (not shown). The visualized toner image on the photosensitive drum 1 is transferred onto the recording medium 14 by the action of the transfer roller 10.

The recording medium 14 on which the toner image has been transferred in the transfer nip portion T is separated from the surface of the photosensitive drum 1 and conveyed to the fixing unit 11. In the fixing unit 11, the unfixed toner image on the recording medium 14 is fixed to the recording medium 14 as a firmly fixed image by heat and pressure. The recording medium 14 is thereafter discharged by the discharging rollers 13 onto the discharge portion 16 outside the apparatus main body 50A.

Untransferred toner which has not been transferred onto the recording medium 14 and remains on the photosensitive drum 1 is scraped off the photosensitive drum 1 by the cleaning blade 3 and contained in the untransferred toner container (waste toner container) 20. The cleaned photosensitive drum 1 is repeatedly put into use for image formation in the same manner as described above.

<Operation Steps of the Image Forming Apparatus>

Figure 7:
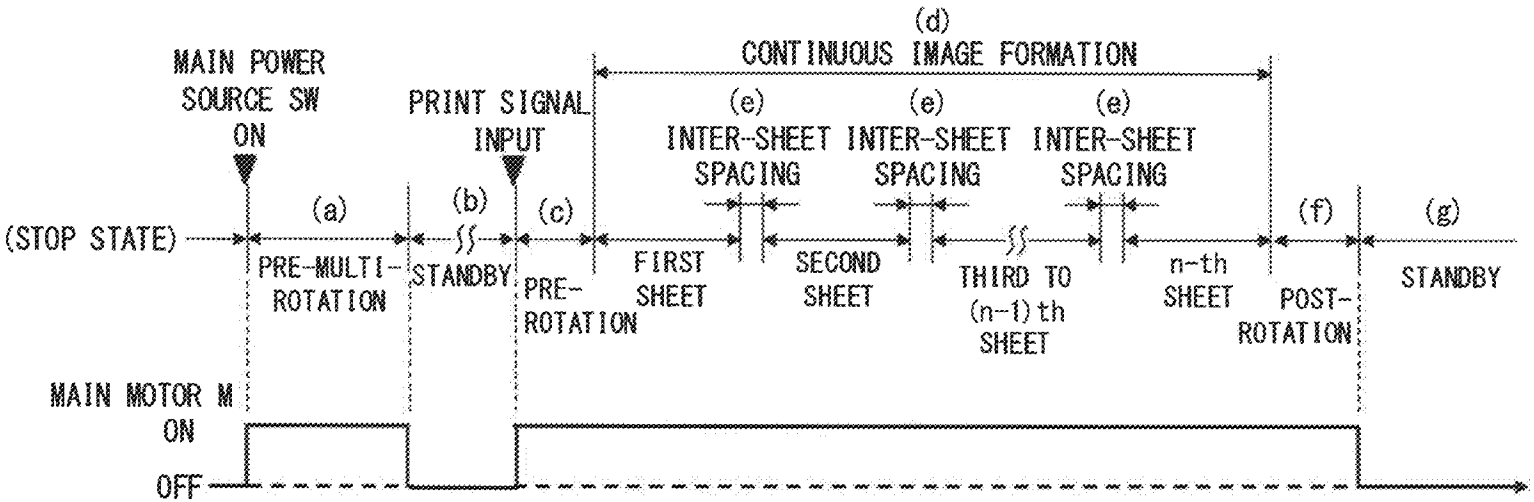
FIG. 7 is an operation chart illustrating operation steps of the image forming apparatus.

FIG. 7 is an operation chart illustrating the operation steps of the image forming apparatus 50 in an image forming process executed by the CPU 35 which is the control unit.

(a) Pre-Multi-Rotation Operation

Pre-multi-rotation operation is an apparatus start-up operation step (warming operation step) which is executed when a main power switch SW of the image forming apparatus 50 is turned on. In the step, a main motor M is started up to drive and rotate the photosensitive drum 1, and given process devices execute given start-up operations.

(b) Standby

Standby is a state in which the main motor M is stopped after the completion of the given multi-rotation operation to wait for the input of a print signal (image signal: image formation execution request) to the video controller 33 from the host device 100.

(c) Pre-Rotation Operation

Pre-rotation operation is a before-image formation operation step which is executed when a print signal is input from the host device 100 to the video controller 33. In the step, the main motor M is driven to drive and rotate the photosensitive drum 1, and given process devices execute a given before-image formation operation. The pre-rotation operation is executed in succession to the pre-multi-rotation operation in the case where a print signal is input during the pre-multi-rotation operation.

(d) Image Forming Operation

Image forming operation is an image creating operation step of forming on the recording medium 14 an image which corresponds to image information input from the host device 100 to the video controller 33. The image forming operation is executed following the completion of the given pre-rotation operation. In the case of a continuous image formation mode, the image forming operation for one sheet of the recording medium 14 is executed repeatedly as many times as a set number of image forming sheets.

(e) Inter-Sheet Spacing

The inter-sheet spacing is a space between the image forming operation for one sheet of the recording medium 14 and the image forming operation for the next sheet of the recording medium 14 in the continuous image formation mode.

(f) Post-Rotation Operation

Post-rotation operation is a post operation step which is executed after the image forming operation is completed for one sheet of the recording medium 14 or a set number of sheets of the recording medium 14. The main motor M is kept driving for a given length of time after the completion of the image forming operation to allow given process devices to execute given finishing operations.

(g) Standby

After the given post-rotation operation is completed, the main motor M is stopped and the image forming apparatus 50 enters a state in which the input of the next print signal from the host device 100 to the video controller 33 is waited for. When the next print signal is input, the operation period described above which includes the pre-rotation operation, the image forming operation, and the post-rotation operation is executed again.

Of the operation steps described above, the pre-multi-rotation operation, the pre-rotation operation, the inter-sheet spacing in continuous image forming operation, and the post-rotation operation are periods in which no image is being formed on the photosensitive drum 1. A drum surface area relevant to these non-image forming periods is a non-image forming area. A period in which an image is being formed for the recording medium 14 on the drum surface is an image forming period. A drum surface area relevant to the image forming period is an image forming area.

Figure 8B:
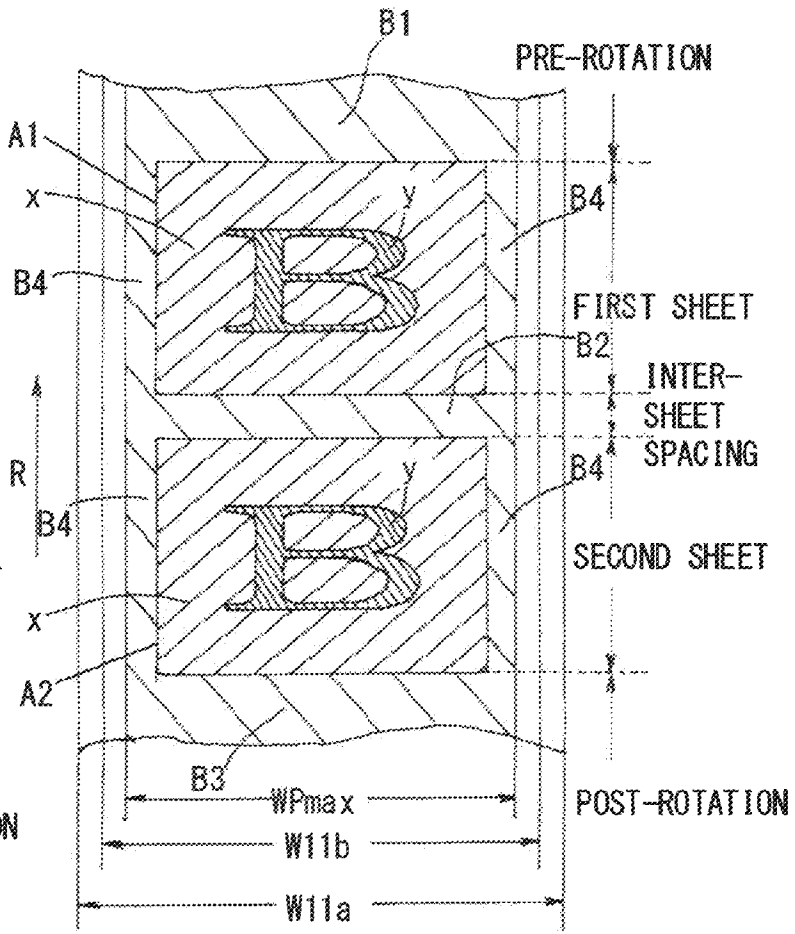
FIGS. 8A and 8B are schematic diagrams illustrating a print area and a non-print area of an image forming area and a non-image forming area on a drum surface.
Figure 8A:
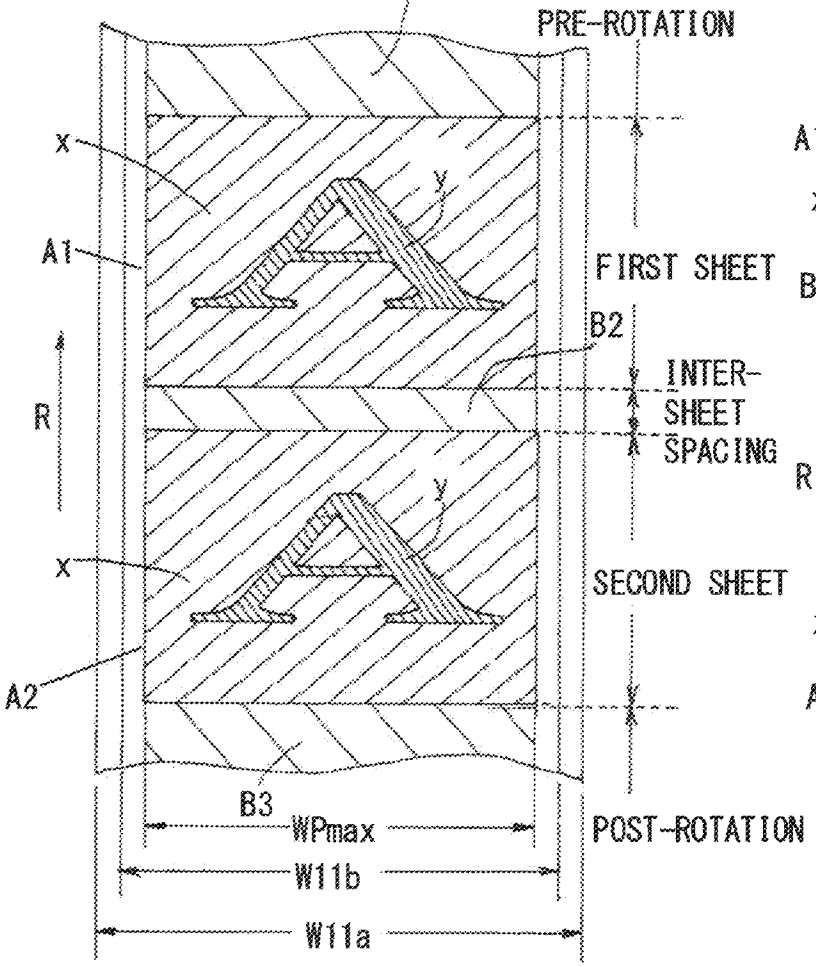

FIGS. 8A and 8B are schematic diagrams (conceptual diagrams) illustrating a print area and non-print area of an image forming area on the drum surface and a non-image forming area on the drum surface in the operation steps of the image forming apparatus 50 described above. Both FIG. 8A and FIG. 8B are development views in a rotation direction (surface moving direction) R of the photosensitive drum surface.

The base material of the photosensitive drum 1 is an aluminum cylinder which has a full width (full length dimension) W11*a*. On a surface of the aluminum cylinder, a photosensitive layer (thin-film coating layer made up of a charge generating layer and a charge transporting layer) is formed, which has a full width W11*b*. Denoted by WPmax is the maximum sheet passing width. The widths satisfy W11*a*>W11*b*≥WPmax. The width of charging by the charging roller 2, the maximum width of exposure (maximum main scan exposure width) by the scanner unit 30, which is the exposure unit, and the width of development by the developing roller 5 are equivalent to the maximum sheet passing width WPmax, or are set slightly wider than WPmax.

FIG. 8A illustrates a case of forming images on two sheets of the recording medium 14 which are as wide as the maximum sheet passing width WPmax and which are fed in succession. In the example, the recording medium 14 which is as wide as the maximum sheet passing width WPmax is a size A4 (210 mm×297 mm) recording material and is conveyed laterally.

An image forming area A1 and an image forming area A2 are where images are formed on the first sheet of recording material and the second sheet of recording material, respectively. The image forming areas A1 and A2 each have a print area (exposure section) y where a toner image is formed and a non-print area (non-exposure section) x where no toner image is formed. In the image forming apparatus 50 of the embodiment, a toner image is formed when toner adheres to a print area which is an exposure section by a reversal development.

A non-image forming area B1 is relevant to the pre-rotation operation period, a non-image forming area B2 is relevant to the inter-sheet spacing period between the first sheet and second sheet of the recording medium 14, and a non-image forming area B3 is relevant to the post-rotation operation period. These non-image forming areas B1 to B3 are, similarly to the respective non-print areas x of the image forming areas A1 and A2, non-print areas where no toner image is formed.

FIG. 8B illustrates a case of forming images on two sheets of the recording medium 14 which are narrower than the maximum sheet passing width WPmax and which are fed in succession. In the example, the recording medium 14 which is narrower than the maximum sheet passing width WPmax is a size B5 (182 mm×257 mm) recording material and is conveyed laterally with the center as a reference. The first sheet and the second sheet of the recording medium 14 in this case respectively have non-image forming areas B4 on both sides in the width direction of the image forming area A1 and the image forming area A2, due to the width difference from the maximum sheet passing width WPmax. The non-image forming areas B4, too, are non-print areas where no toner image is formed.

<About Exposure Operation>

In the configuration of the embodiment, negative DC voltages with given electric potentials are applied to the charging roller 2 and the developing roller 5 as charging bias and developing bias, respectively. Specifically, the power source unit (not shown) applies −1,000 V to the charging roller 2 and −400 V to the developing roller 5. Keeping the charging bias and the developing bias at these voltage values minimizes the number of electrical parts, and the power source unit can thus be reduced in size.

With the fixed voltages, a change of environment may cause the electric potential of the photosensitive drum surface to deviate from a desired electric potential. The configuration of the embodiment corrects this by background area exposure in which non-print areas where no toner image is formed, namely, the non-print areas x of the image forming areas A and the non-image forming areas B (B1 to B4) are exposed to laser light as well.

The CPU 35 controls the intensity of laser light emission in the background area exposure based on temperature/humidity information which is detected by the environment sensor C. The surface electric potential of the photosensitive drum 1 can thus be changed back to the intended electric potential even if deviated after charging due to environment.

How the surface of the photosensitive drum 1 is exposed to light in the embodiment will be described next in detail. The photosensitive drum 1 is irradiated with laser by scanning in a direction orthogonal to the rotation direction R of the photosensitive drum 1. The direction orthogonal to the rotation direction R of the photosensitive drum 1 is hereinafter referred to as main scanning direction. The timing of laser light emission is controlled with signals which are input from the video controller 33 to the laser driver 31 as described above.

Specifically, the video controller 33, which is the signal output portion configured to output an electric signal to instruct the scanner unit 30 serving as the exposure unit to perform exposure, outputs a first electric signal when the scanner unit 30 is to expose the print area y of the photosensitive drum 1 to light. The video controller 33 outputs a second electric signal for instructing the scanner unit 30 to shorten an exposure time per unit area of the photosensitive drum 1 more than an exposure time of the first electric signal when the scanner unit 30 is to expose the non-print areas x and B (B1 to B4) of the photosensitive drum 1 to light (background area exposure).

In the exposure of the embodiment, a stretch of approximately 40 μm in the main scanning direction constitutes one area (1 dot) in order to achieve an image resolution of 600 dpi. One dot is divided into approximately ten segments for light emission control.

A width of at least 20 μm of the print area y in each image forming area A is exposed to light to form a toner image. This is because a stretch of at least 20 μm is required in order to form a latent image necessary for forming a toner image on the photosensitive drum 1.

In the background area exposure of the non-print areas x and B (B1 to B4), on the other hand, a width of 4 to 8 μm of the non-print areas is exposed to light. The surface electric potential of the non-print areas x and B (B1 to B4) of the photosensitive drum 1 can thus be controlled without developing toner.

The background area exposure of the non-print areas x and B (B1 to B4) has hitherto been done by continuously exposing the non-print areas to laser light with a lessened emission intensity. The embodiment uses the intermittent exposure method as described above. The conventional background area exposure method needs a wide output light intensity range from the weak light intensity for background area exposure to the strong light intensity for toner image formation. In addition, the conventional method requires precision throughout this light intensity range, and therefore calls for an expensive laser element.

The embodiment employs a method in which the non-print areas are exposed intermittently for each dot to laser light having the same light intensity which is used to form a toner image, by shortening the light emission time instead of reducing the laser light intensity. This enables the image forming apparatus to use a laser element with a limited light intensity range. Another advantage is that the sensitivity characteristics of the photosensitive drum 1 are more stable when exposed to light in a strong light intensity.

<Toner Use Amount Detection>

In the embodiment, video signals which are input to the laser driver 31 in order to detect the toner use amount are measured by the count unit (count portion: measurement portion) 34. The count unit 34 is provided between the video controller 33 and the laser driver 31 as illustrated in FIG. 1 to directly detect signals input to the laser driver 31. This way, laser light emission which is relevant to toner consumption can be counted directly.

With the conventional method of calculating the toner use amount from image information sent from the host device 100, it is difficult to detect the amount of toner used in regular toner ejection operation, density detection control, and the like that are controlled by the CPU 35 serving as the control unit. The method of the embodiment, which is capable of detecting laser light emission without fail and accordingly capable of detecting the toner use amount accurately, is free of this problem. The count unit 34 counts a video signal input from the video controller 33 when the signal is in the ON-state, and accumulates the count.

Figure 2:
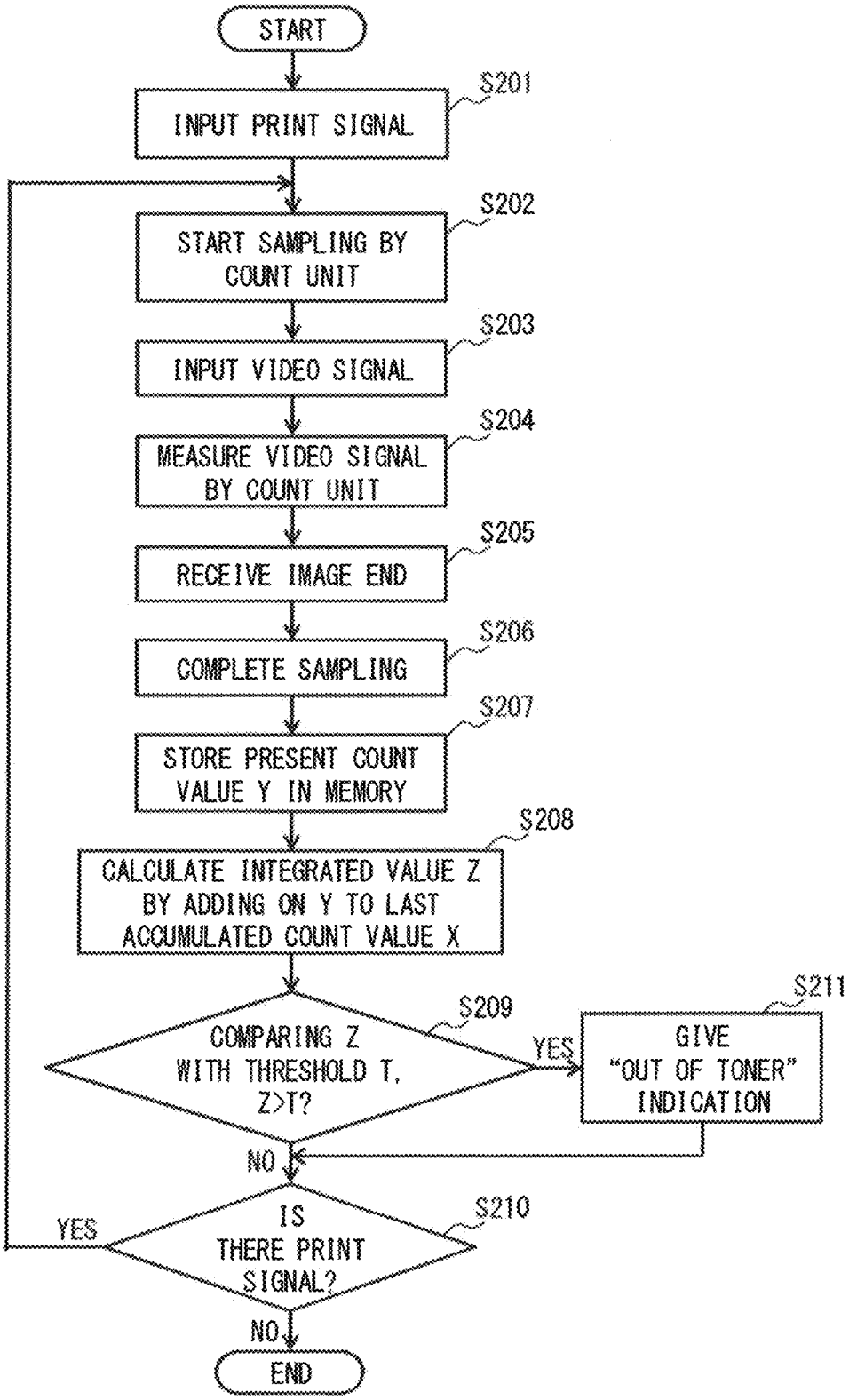
FIG. 2 is a flow of detecting the amount of toner used to form an image.

A concrete flow of toner use amount detection in image formation will be described next with reference to FIG. 2. When a print signal is input to the video controller 33 from the host device 100 (S201), the count unit 34 starts sampling (S202). The count unit 34 measures video signals input from the video controller 33 to the laser driver 31 (S203 and S204). The count unit 34 receives image end information (S205), at which point the count unit 34 completes sampling (S206).

A value Y measured by the count unit 34 is aggregated for each image sheet, and is temporarily stored via the CPU 35 in a memory (main body memory) 36 mounted in the image forming apparatus main body 50A (S207). The non-volatile memory 26 mounted in the process cartridge B stores an integrated value X of the video count accumulated up to that point, and a video count threshold T which is determined in advance. The stored values are read out of the non-volatile memory 26 in advance and kept in the memory 36 via the CPU 35.

An integrated value Z is calculated by adding the value Y of the count counted in image formation this time to the accumulated count value X (S208). The integrated value Z is compared with the predetermined threshold T (S209). When the integrated value Z is larger than the threshold (YES in S209), "out of toner" indication is given (S211). When the integrated value Z does not exceed the threshold (NO in S209), the detection is ended if no print signal is input (NO in S210), and the same process is executed again if a print signal is input (YES in S210). The toner use amount is detected in this manner and whether there is toner or not is determined.

However, as described above, the method of directly detecting video signals which enter the laser driver 31 detects video signals for causing laser light emission in the background area exposure as well.

To solve the problem, the embodiment uses the following method to discriminate video signals for toner image formation from video signals for background area exposure, and to measure only video signals for toner image formation. Specifically, the method involves allowing the count unit 34 to which the first electric signal (video signal for toner image formation) and second electric signal (video signal for background area exposure) described above are input from the video controller 33 to measure only the first electric signal without measuring the second electric signal.

Figure 3:
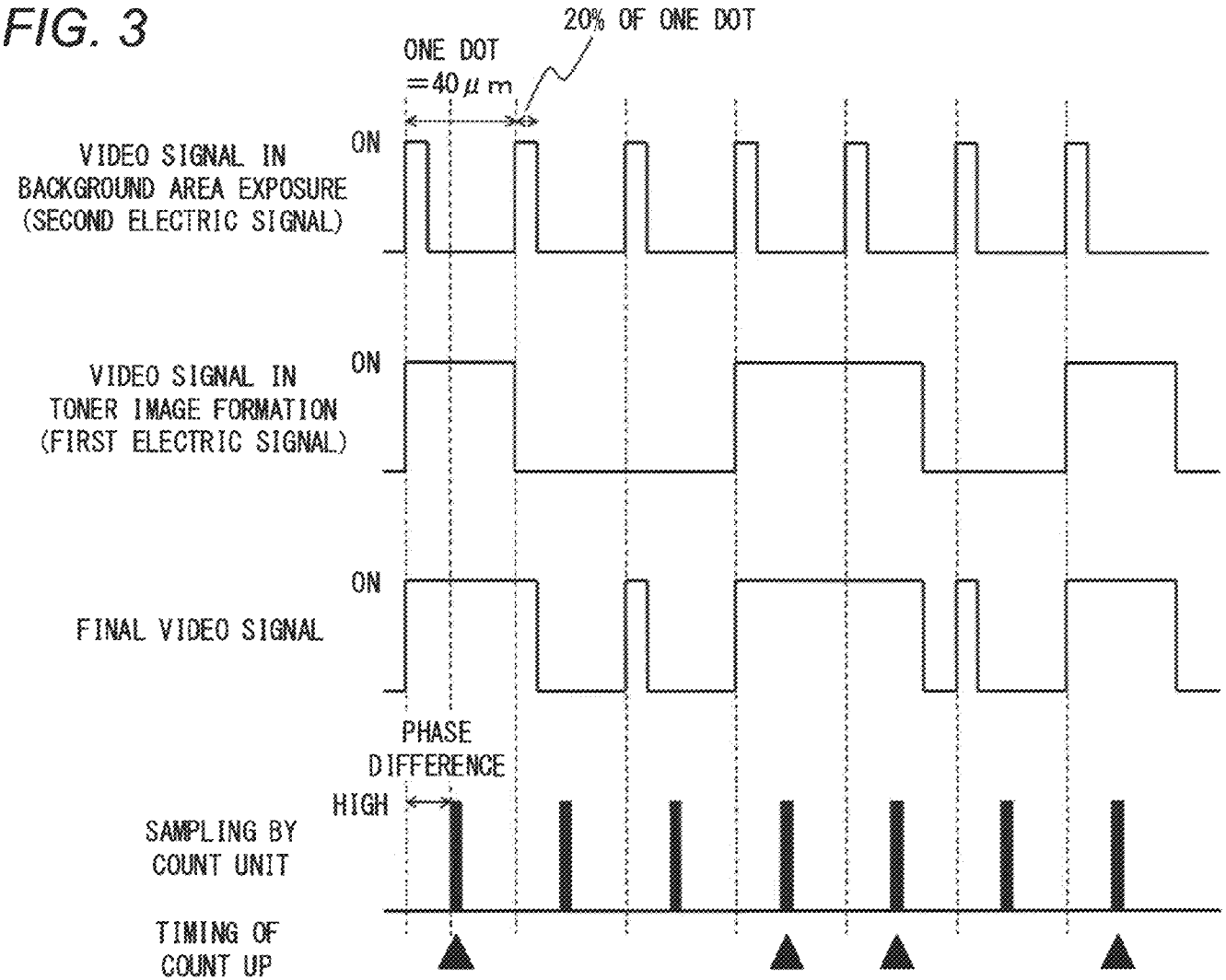
FIG. 3 is a diagram illustrating a mode of timing of exposure and video counting in the image forming apparatus according to the first embodiment.

As described above, the background area exposure of the embodiment exposes a width of approximately 10% to 20% of 1 dot to light, whereas a width of 50% or more of 1 dot is exposed to light when a toner image is formed. The final video signal in which the video signal for background area exposure and the video signal for toner image formation overlap as illustrated in FIG. 3 is input from the video controller 33 via the count unit 34 to the laser driver 31 of the scanner unit 30, which is the exposure unit (exposure device).

The count unit 34 conducts sampling (measuring) in predetermined periods, and determines whether or not a detected video signal is in the ON-state. The sampling time of the count unit 34 is shorter than the light emission time of background area exposure, and counts a video signal if the video signal is in the ON-state even for an instant when the detection state of the count unit 34 is "high".

The embodiment prevents the count unit 34 from counting video signals for background area exposure as follows. Specifically, the sampling period (measurement period) of the count unit 34 and the light emission period of background area exposure are set to the same period, and a phase difference is provided between the two as illustrated in FIG. 3. The phase difference between the sampling period and the light emission period is more than the light emission time of background area exposure (the phase difference is greater than a length of exposure time instructed by the second electric signal), and is less than the light emission time for 1 dot. The phase difference in the embodiment is set to about 40% of the light emission time for 1 dot.

In short, the measurement timing of the count unit 34 is set so as to differ from the timing of inputting the second electric signal which is a video signal for background area exposure to the count unit 34.

This guarantees that a video signal for background area exposure (the second electric signal) is not input while the count unit 34 is conducting detection. The count unit 34 consequently detects only a video signal for toner image formation (the first electric signal).

Figure 4:
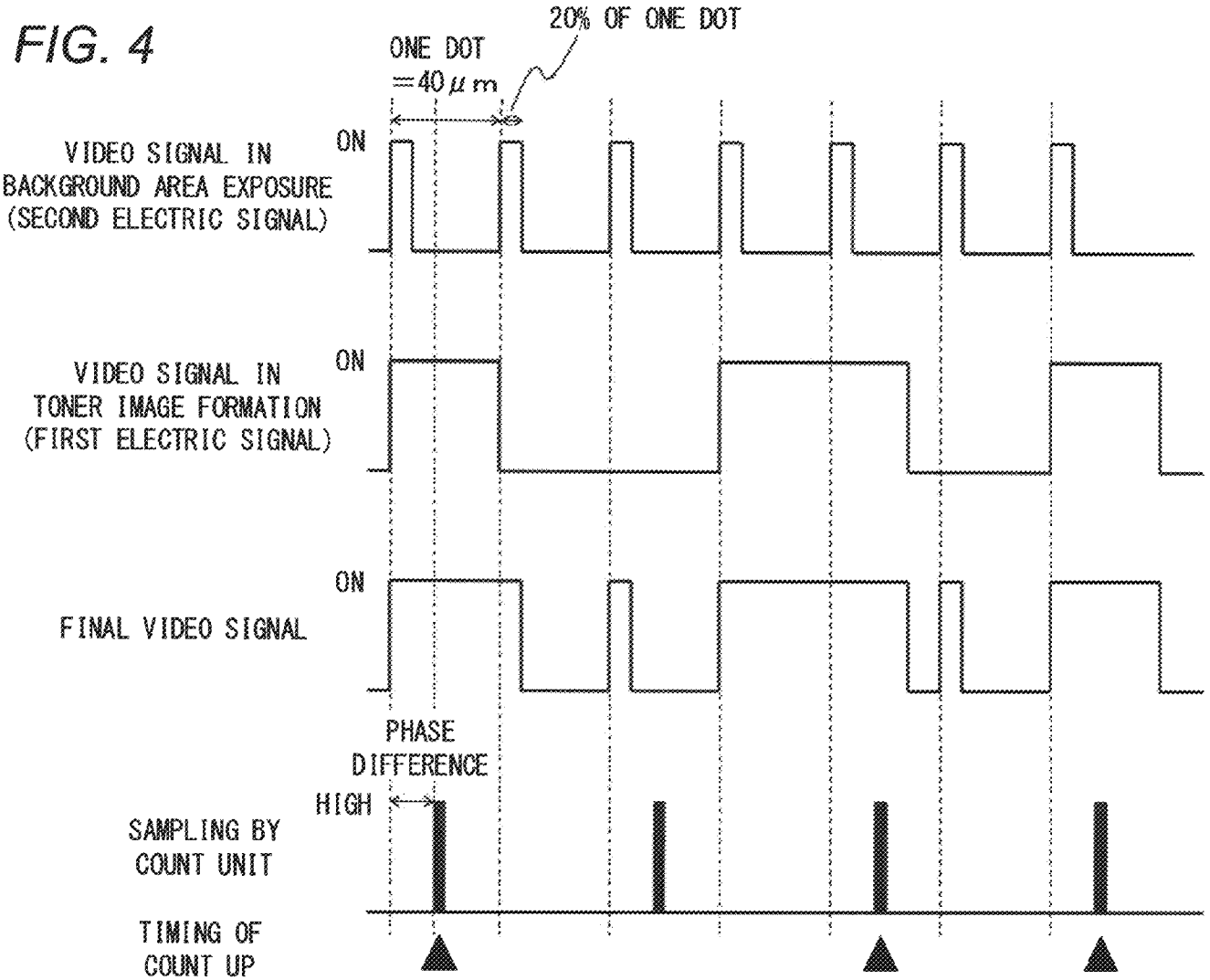
FIG. 4 is a diagram illustrating another mode of timing of exposure and video counting in the image forming apparatus according to the first embodiment.

The sampling period of the count unit 34 and the light emission period of background area exposure, which are set to the same period in the embodiment, are not limited thereto. As illustrated in FIG. 4, the sampling period of the count unit 34 may be an integral multiple of the light emission period of background area exposure (a period in which the second electric signal is input to the count unit 34).

Executing sampling for each dot ensures that exposure for toner image formation is counted, but needs to process that much more information. If counting in 2-dot period as illustrated in FIG. 4 does not affect the prediction of the toner use amount, reducing the sampling number by extending the sampling period is an effective way to lighten the load of information processing.

Second Embodiment

A second embodiment of the present invention uses an image forming apparatus the configuration of which is substantially the same as the one in the first embodiment. The second embodiment differs from the first embodiment in how the count unit 34 manages to measure only video signals for toner image formation.

Figure 5:
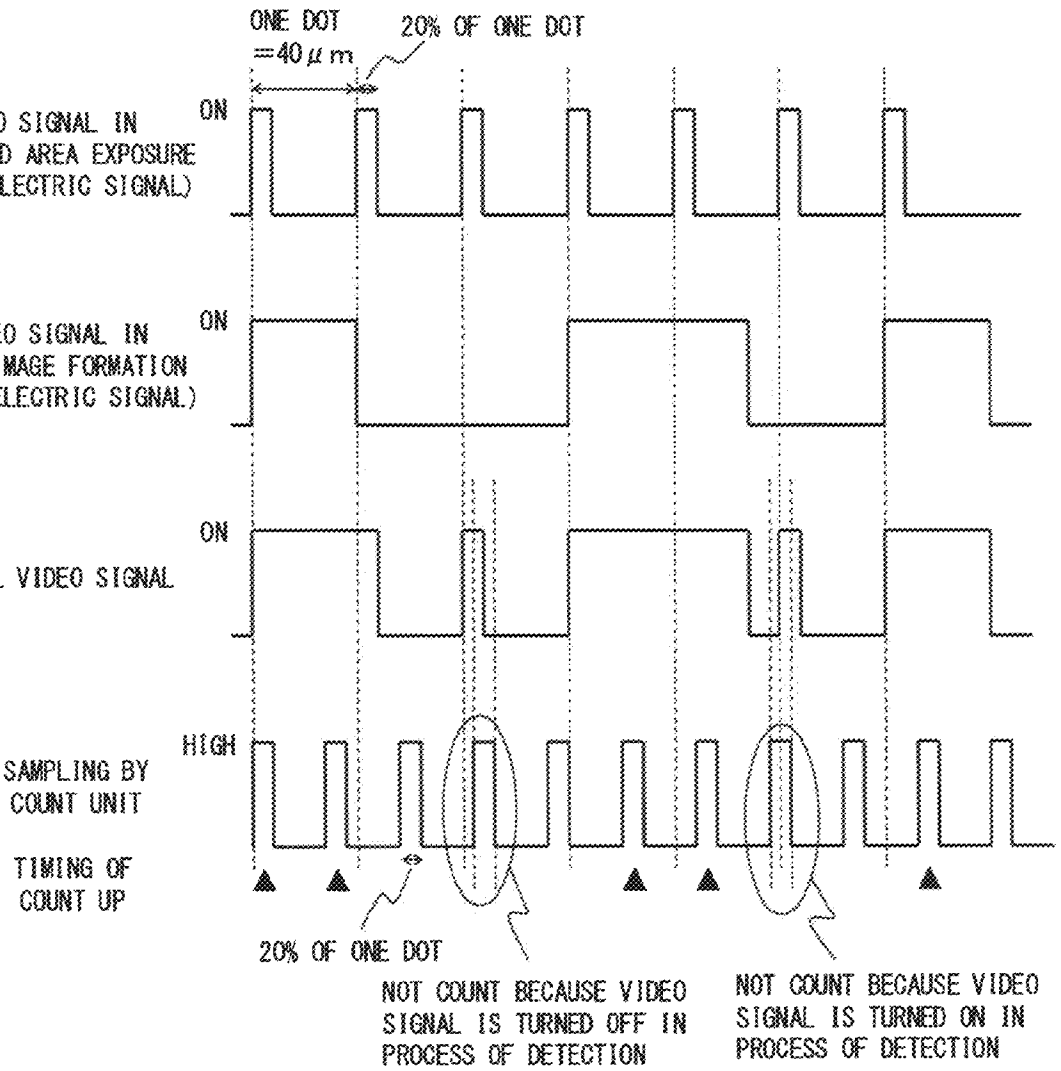
FIG. 5 is a diagram illustrating a mode of timing of exposure and video counting in an image forming apparatus according to a second embodiment.

As illustrated in FIG. 5, the final video signal in which the video signal for background area exposure and the video signal for toner image formation overlap is input to the laser driver 31. The count unit 34 executes sampling in predetermined periods, and determines whether or not a sampled video signal is in the ON-state. A condition that needs to be met for a video signal to be detected as the ON-state is "the ON-state lasts a predetermined length of time or longer." In other words, the second embodiment has such a feature that the count unit 34 counts a signal input to the count unit 34 when the signal instructs a longer exposure time than the exposure time instructed by the second electric signal which is a video signal for background area exposure.

Specifically, the count unit 34 counts a video signal when the video signal is continuously in the ON-state while the detection state of the count unit 34 is "high" as illustrated in FIG. 5. The count unit 34 does not count a video signal when the video signal changes to the OFF-state in process of detection, or when the detection state of the count unit 34 turns to "high" in process of detection. The detection state (the width of "high") of the count unit 34 is set wider than a width for light emission in background area exposure. The width of "high" for sampling is set here to 21% of 1 dot.

This enables the count unit 34 to detect only video signals for toner image formation without counting video signals for background area exposure. The sampling period of the count unit 34 in the embodiment is a period of 70% of 1 dot.

Third Embodiment

A third embodiment of the present invention uses an image forming apparatus the configuration of which is substantially the same as the one in the first embodiment. A feature of the third embodiment, too, resides in how the count unit 34 manages to measure only video signals for toner image formation.

The sampling period of the count unit 34 is set very short in the third embodiment, and is shorter than the period of video signals (the first electric signal and the second electric signal). Specifically, sampling is executed in a period of 20% of 1 dot. As in the first embodiment, a width of 10 to 20% of 1 dot is exposed to light in background area exposure and a width of 50% or more of 1 dot is exposed to light to form a toner image. The count unit 34 counts only video signals for toner image formation by utilizing this difference in exposure width.

Figure 6:
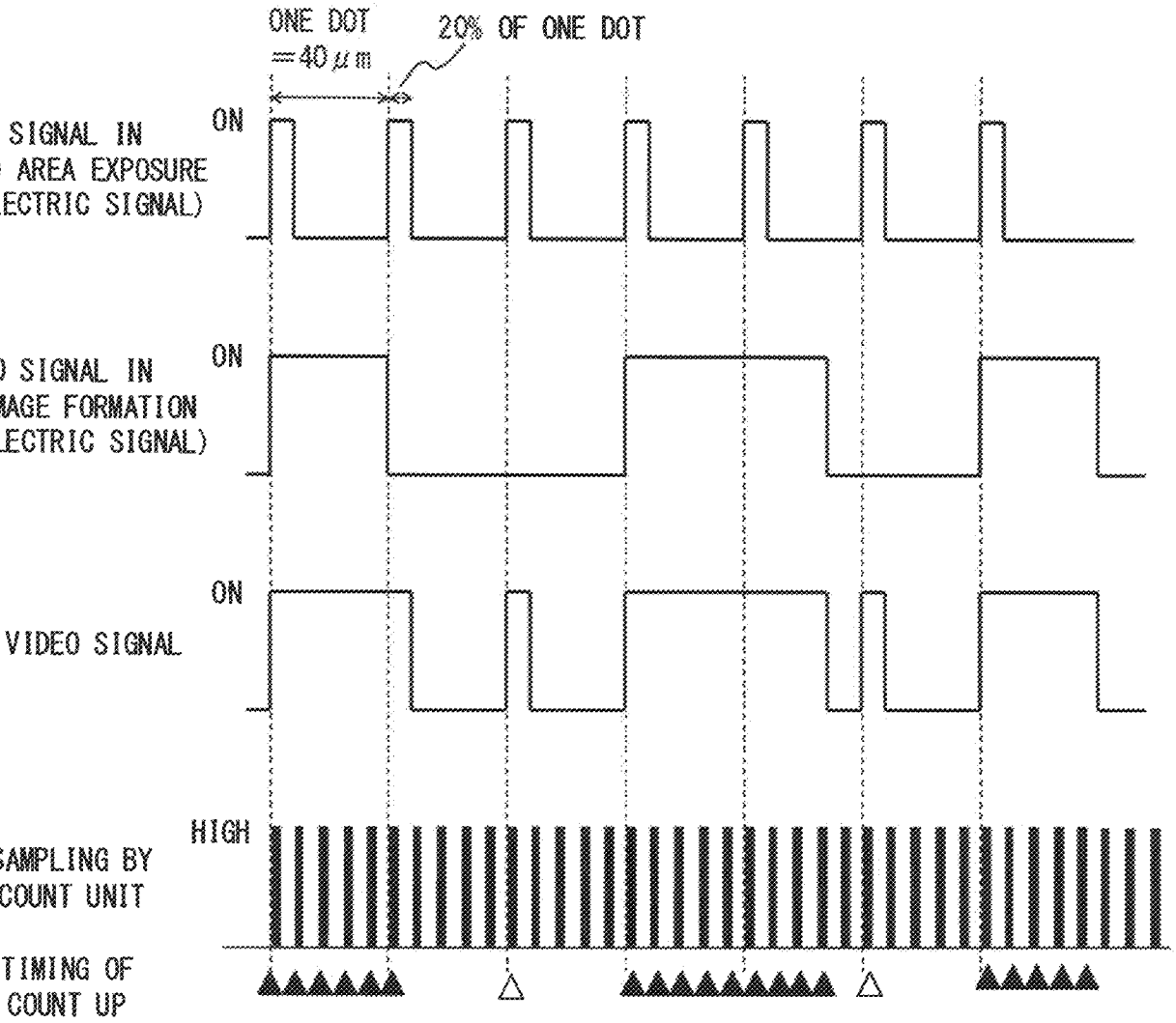
FIG. 6 is a diagram illustrating a mode of timing of exposure and video counting in an image forming apparatus according to a third embodiment.

As illustrated in FIG. 6, the video signal for toner image formation is detected twice or more in succession without exception because the sampling period of the count unit 34 is a period of 20% of 1 dot. The video signal for background area exposure which instructs a short light emission time (the duration for which the ON-state lasts) is not detected twice in succession by the count unit 34. The count unit of the embodiment is therefore designed so as to increment (count up) the count of the video signal counter when a video signal is counted twice or more in succession.

The count unit can discriminate a signal for toner image formation (the first electric signal) from a signal for background area exposure (the second electric signal) by the number of times the video signal is detected in succession. In other words, the count unit can identify the length of the light emission time (the duration for which the ON-state lasts) instructed by a video signal based on the number of times the video signal is detected in succession. The second electric signal (signal for background area exposure) which instructs a short light emission time is not detected in succession by the count unit (or detected in succession a fewer number of times than the first electric signal). The count unit discriminates the first electric signal from the second electric signal in this manner, and does not increment (count up) the video signal count when the second electric signal is detected.

Black triangular marks in FIG. 6 are counted and white triangular marks in FIG. 6 are not counted. This ensures that only video signals for toner image formation are measured, thereby preventing video signals for background area exposure from affecting the video signal count.

The configurations of the first to third embodiments ensure that only video signals for toner image formation are measured, without the video signal count being affected by video signals for background area exposure. An image forming apparatus which practices background area exposure can thus precisely detect the toner use amount based on video signals.

The first to third embodiments use background area exposure in order to control the surface electric potential of the photosensitive drum. However, the present invention is not limited thereto and the toner use amount detection methods based on video signals are effective also when background area exposure is used to control the transfer memory.

According to the embodiments described above, measuring only signals for exposure of a print area without measuring signals for exposure of a non-print area is accomplished by utilizing the characteristics of exposure of a non-print area and the characteristics of exposure of a print area.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-272102, filed Dec. 13, 2012, which is hereby incorporated by reference herein in its entirety.

What is claimed is:

1. An image forming apparatus, comprising:

an image bearing member;

a charging device configured to charge a surface of the image bearing member;

an exposure device configured to expose to light the image bearing member which has been charged by the charging device to form an electrostatic latent image, the exposure device intermittently irradiating the image bearing member with light for each unit area of the image bearing member;

a developing device configured to develop the electrostatic latent image with developer;

a signal output portion configured to output an electric signal which instructs the exposure device to perform exposure, the signal output portion outputting a first electric signal when the exposure device is to expose a print area of the image bearing member to light, and outputting a second electric signal, which instructs the exposure device to shorten an exposure time per unit area of the image bearing member more than an exposure time of the first electric signal, when the exposure device is to expose a non-print area of the image bearing member to light; and a count portion, to which the first electric signal and the second electric signal are input from the signal output portion, configured to measure only the first electric signal without measuring the second electric signal, wherein a timing at which the count portion measures differs from a timing at which the second electric signal is input to the count portion.

2. An image forming apparatus according to claim 1, wherein a measurement period of the count portion comprises an integral multiple of a period in which the second electric signal is input to the count portion, and a phase difference between the timing at which the count portion measures and the timing at which the second electric signal is input to the count portion is larger than the exposure time instructed by the second electric signal.

3. An image forming apparatus, comprising:

an image bearing member;

a charging device configured to charge a surface of the image bearing member;

an exposure device configured to expose to light the image bearing member which has been charged by the charging device to form an electrostatic latent image, the exposure device intermittently irradiating the image bearing member with light for each unit area of the image bearing member;

a developing device configured to develop the electrostatic latent image with developer;

a signal output portion configured to output an electric signal which instructs the exposure device to perform exposure, the signal output portion outputting a first electric signal when the exposure device is to expose a print area of the image bearing member to light, and outputting a second electric signal, which instructs the exposure device to shorten an exposure time per unit area of the image bearing member more than an exposure time of the first electric signal, when the exposure device is to expose a non-print area of the image bearing member to light; and a count portion, to which the first electric signal and the second electric signal are input from the signal output portion, configured to measure only the first electric signal without measuring the second electric signal, wherein a measurement period of the count portion is shorter than a period of the first electric signal and a period of the second electric signal, and wherein whether a detected electric signal is the first electric signal or the second electric signal is determined based on a number of times the electric signal is detected in succession by the count portion.

* * * * *